US006467204B1

(12) United States Patent
Creighton et al.

(10) Patent No.: US 6,467,204 B1
(45) Date of Patent: Oct. 22, 2002

(54) ADAPTER ASSEMBLY HAVING MULTIPLE RETAINER PINS

(75) Inventors: George S. Creighton, Flower Mound, TX (US); Peter Scott Mautino, Pittsburgh, PA (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/925,999

(22) Filed: Aug. 9, 2001

(51) Int. Cl.[7] ..... E02F 9/28
(52) U.S. Cl. ..... 37/456
(58) Field of Search ..... 37/452, 453, 454, 37/455, 456, 458; 172/702, 701.3, 713, 772, 772.5; 403/333, 334

(56) References Cited

U.S. PATENT DOCUMENTS

| | | | | |
|---|---|---|---|---|
| 1,216,290 | A | 2/1917 | Dickson | |
| 1,419,047 | A | 6/1922 | Hanks et al. | |
| 1,845,677 | A | 2/1932 | Mekeel | |
| 2,064,059 | A | 12/1936 | Fellmeth | 37/142 |
| 2,113,420 | A | 4/1938 | Younie | 37/141 |
| 2,618,873 | A | 11/1952 | Hostetter | 37/142 |
| 2,635,366 | A | 4/1953 | Hostetter | 37/142 |
| 2,689,419 | A | 9/1954 | Daniels et al. | 37/142 |
| 2,934,842 | A | 5/1960 | Van Buskirk | 37/142 |
| 3,498,677 | A | 3/1970 | Morrow | 299/86 |
| 3,787,132 | A | 1/1974 | Garnett | 403/290 |
| 3,839,805 | A | 10/1974 | Stepe | 37/142 |
| 3,896,569 | A | 7/1975 | Thompson et al. | 37/141 |
| 3,967,399 | A | 7/1976 | Heinold et al. | 37/142 |
| 3,974,579 | A | 8/1976 | Black et al. | 37/141 |
| 3,982,339 | A | 9/1976 | Nilsson | 37/141 |
| 4,067,657 | A | 1/1978 | Kaariela | 403/317 |
| 4,233,761 | A | 11/1980 | Ryerson | 37/142 |
| 4,247,147 | A | 1/1981 | Rettkowski | 299/10 |
| 4,326,348 | A | 4/1982 | Emrich | 37/142 |
| 4,335,532 | A | 6/1982 | Hahn et al. | 37/142 |
| 4,404,760 | A | 9/1983 | Hahn et al. | 37/142 |
| 4,481,728 | A | 11/1984 | Mulder et al. | 37/142 |
| 4,587,751 | A | 5/1986 | Sjogren et al. | 37/142 |
| 4,662,762 | A | 5/1987 | Schwarz | 384/25 |
| 4,663,867 | A | 5/1987 | Hahn et al. | 37/142 |
| 4,716,667 | A | 1/1988 | Martin | 37/142 |
| 4,727,663 | A | 3/1988 | Hahn | 37/142 |
| 4,823,487 | A | 4/1989 | Robinson | 37/142 |
| RE33,042 | E | 9/1989 | Emrich | 37/142 |
| 4,895,459 | A | 1/1990 | Werner | 384/43 |
| 4,941,758 | A | 7/1990 | Osawa | 384/40 |
| 5,009,017 | A | 4/1991 | Diekevers et al. | 37/142 |
| 5,074,062 | A | 12/1991 | Hahn et al. | 37/142 |

(List continued on next page.)

OTHER PUBLICATIONS

"Dragline Products—Hensley Style" (eleven pages) no date.
"Keech Castings Australia PTY, Limited," Aug. 31, 1995 (one page).
"Maglok® System," *Quality Steel Foundries Ltd.* no date.
"Mining Vertalok® Adapters for Shovel Dippers," ©1992 ESCO Corporation. (4 pages).
"Posilok® Tooth Systems" (one page) no date.
"Torqlok® System," *Quality Steel Foundries Ltd.* (one page) no date.

*Primary Examiner*—Robert E. Pezzuto
(74) *Attorney, Agent, or Firm*—Baker Botts L.L.P.

(57) ABSTRACT

An adapter assembly which includes an adapter having first and second adapter ends and first and second adapter sides. A removable tooth having first and second tooth sides is coupled with the adapter, and at least partially covers the first adapter end. A retainer pin extends at least partially through first and second openings of the first and second tooth sides, respectively and through an elongate slot of the adapter. The retainer pin is operable to cooperate with the adapter adjacent the first and second openings to couple the removable tooth and the adapter. A secondary retainer pin extends from the adapter at least partially into the elongate slot and engages a recessed portion of the retainer pin, the secondary retainer pin being operable to limit movement of the retainer pin along an imaginary longitudinal axis of the elongate slot.

12 Claims, 3 Drawing Sheets

U.S. PATENT DOCUMENTS

| | | | | | |
|---|---|---|---|---|---|
| 5,081,774 | A | | 1/1992 | Kuwano | 137/142 |
| 5,088,214 | A | | 2/1992 | Jones | 37/141 |
| 5,111,600 | A | | 5/1992 | Lukavich et al. | 37/141 |
| 5,152,088 | A | | 10/1992 | Hahn | 37/142 |
| 5,172,501 | A | | 12/1992 | Pippins | 37/142 |
| 5,181,780 | A | | 1/1993 | Morita | 384/8 |
| 5,233,770 | A | | 8/1993 | Robinson | 37/456 |
| 5,272,824 | A | * | 12/1993 | Cornelius | 37/455 |
| 5,297,873 | A | | 3/1994 | Komiya | 384/45 |
| 5,337,495 | A | | 8/1994 | Pippins | 37/453 |
| 5,361,520 | A | | 11/1994 | Robinson | 37/458 |
| 5,410,826 | A | | 5/1995 | Immel et al. | 37/457 |
| 5,423,138 | A | | 6/1995 | Livesay et al. | 37/456 |
| 5,435,084 | A | | 7/1995 | Immel | 37/398 |
| 5,452,529 | A | | 9/1995 | Neuenfeldt et al. | 37/455 |
| 5,456,029 | A | * | 10/1995 | Cornelius | 172/713 |
| 5,469,648 | A | | 11/1995 | Jones et al. | 37/457 |
| 5,484,210 | A | | 1/1996 | Gallone | 384/49 |
| 5,491,915 | A | | 2/1996 | Robinson | 37/458 |
| 5,638,621 | A | | 6/1997 | Keech et al. | 37/446 |
| 5,709,043 | A | | 1/1998 | Jones et al. | 37/458 |
| 5,802,795 | A | | 9/1998 | Myers et al. | 52/426 |
| 5,926,982 | A | | 7/1999 | Keech et al. | 37/455 |
| 5,937,550 | A | | 8/1999 | Emrich | 37/458 |
| 5,947,209 | A | | 9/1999 | Halford et al. | 172/772.5 |
| 5,983,534 | A | | 11/1999 | Robinson et al. | 37/459 |
| 5,992,063 | A | | 11/1999 | Mack | 37/450 |
| 6,000,153 | A | | 12/1999 | Sollami | 37/453 |
| 6,018,896 | A | | 2/2000 | Adamic | 37/456 |
| 6,052,927 | A | | 4/2000 | Pippins | 37/454 |
| 6,092,958 | A | | 7/2000 | Gale | 403/378 |
| 6,108,950 | A | | 8/2000 | Ruvang et al. | 37/452 |
| 6,119,378 | A | | 9/2000 | Pippins | 37/454 |
| 6,151,812 | A | | 11/2000 | Bierwith | 37/455 |
| 6,247,255 | B1 | | 6/2001 | Clendenning | 37/452 |
| 6,374,521 | B1 | | 4/2002 | Pippins | 37/456 |

* cited by examiner

ADAPTER ASSEMBLY HAVING MULTIPLE RETAINER PINS

TECHNICAL FIELD OF THE INVENTION

The present invention relates generally to replaceable excavation equipment components that are exposed to high wear and repeated shock loading such as removable teeth and adapter assemblies used on excavating machines, and more particularly, to an adapter assembly having multiple retainer pins.

BACKGROUND OF THE INVENTION

Digging and leveling apparatus such as drag lines, back hoes, front-end loaders, bulldozers, and the like often use replaceable teeth and adapter assemblies which are mounted on a tooth horn to provide sacrificial parts that are exposed to the repeated shock loading and high wear occasioned by digging operations. In such systems, adapter assemblies may include a wedge-shaped adapter which mounts directly on the tooth horn of a bucket, shovel or alternative digging or scraping mechanism of the equipment. The wedge-shaped adapter is frontally seated on and coupled with the tooth horn for receiving a removable tooth.

SUMMARY OF THE INVENTION

The present invention includes an adapter assembly having multiple retainer pins that substantially eliminates or reduces disadvantages or problems associated with previously developed fastening methods and apparatus. In particular, the present invention provides a system and method for coupling a removable tooth with an adapter assembly, using a main retainer pin. The lateral movement of the main retainer pin is limited by the use of a secondary retainer pin.

In accordance with a particular embodiment of the present invention, an adapter assembly for use with excavation equipment includes an adapter having first and second adapter ends, and first and second adapter sides. A removable tooth having first and second tooth sides is coupled with the adapter and at least partially covers the first adapter end. A central portion of the adapter defines a first elongate slot which extends from the first adapter side to the second adapter side. The first and second tooth sides include first and second openings, respectively, configured such that the first and second openings are aligned with an imaginary longitudinal axis of the first elongate slot while the removable tooth is coupled with the adapter. A first retainer pin extends at least partially through the first and second openings, and the first elongate slot. The retainer pin is operable to cooperate with the adapter adjacent the first and second openings to couple the removable tooth and the adapter. A second retainer pin extends from the adapter, and at least partially into the first elongate slot, and engages a recessed portion of the first retainer pin. Accordingly, the second retainer pin is operable to limit movement of the first retainer pin along the imaginary longitudinal axis.

In accordance with another embodiment of the present invention, the recessed portion of the first retainer pin comprises a circumferential groove extending along a surface of the first retainer pin. The second retainer extends at least partially through a second elongate slot which extends from a third adapter side, to the first elongate slot.

Technical advantages of particular embodiments of the present invention include a system and method for securely coupling a removable tooth with an adapter using a retainer pin. The retainer pin is prevented from lateral movement, which prevents inadvertent decoupling of the removable tooth and the adapter.

Another technical advantage of particular aspects of the present invention includes a system and method for coupling a removable tooth with an adapter such that the removable tooth and the adapter may be easily decoupled in the field by an operator. The decoupling of the removable tooth from the adapter may be accomplished by using simple hand and/or power tools.

Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Figure 1:
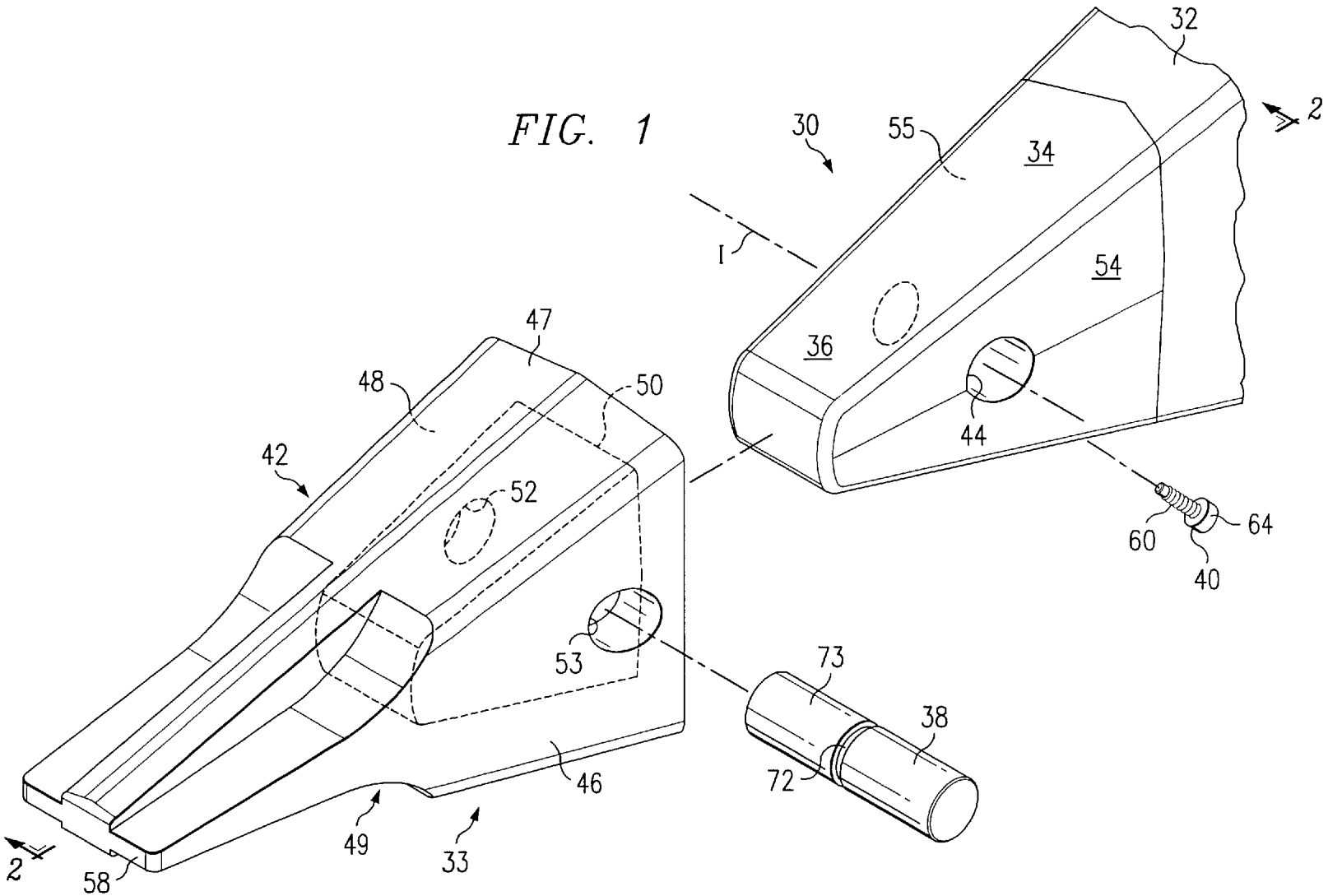
FIG. 1 is an isometric exploded view of an adapter and removable tooth which may be coupled according to a particular embodiment of the present invention.
Figure 2:
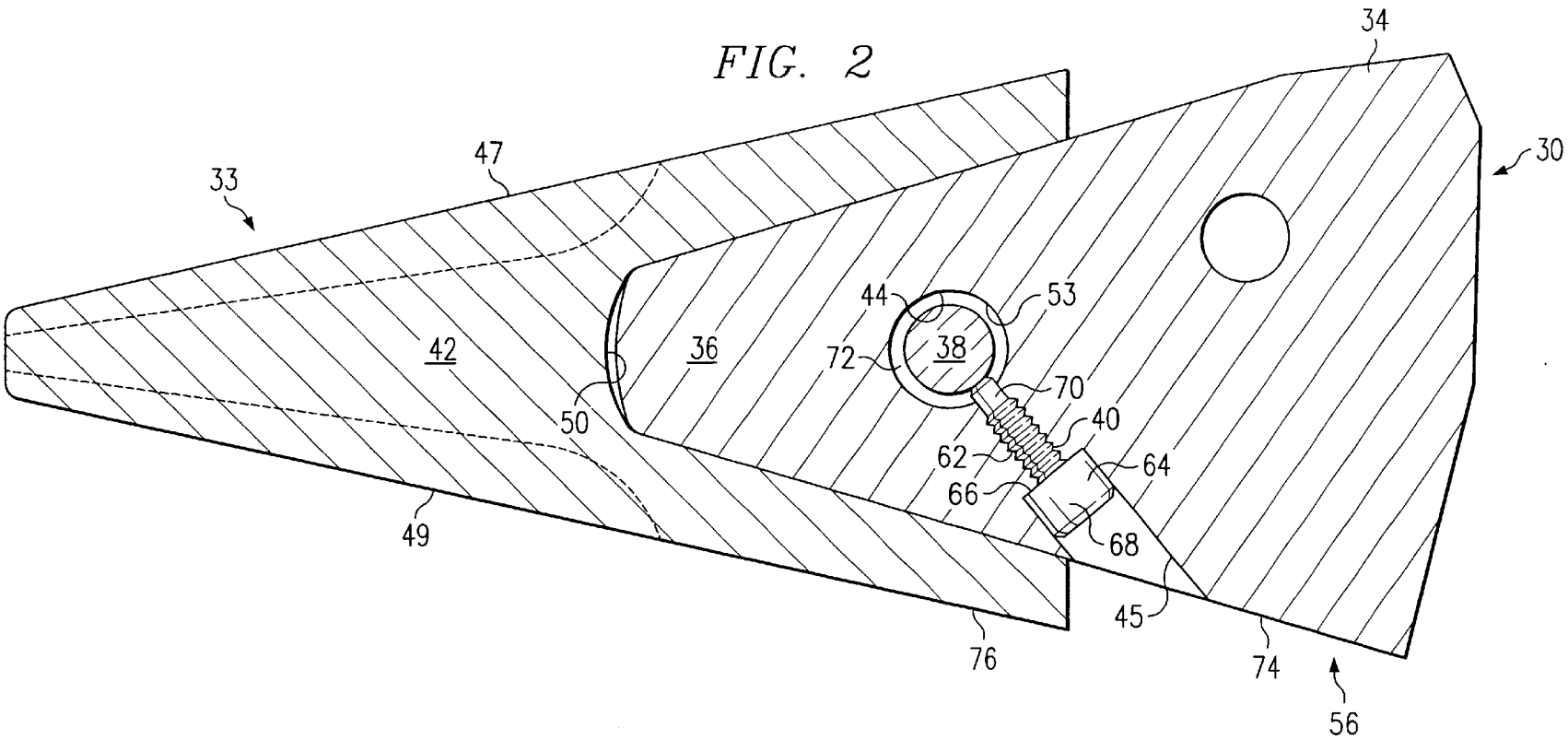
FIG. 2 is a cross sectional view of the removable tooth and adapter assembly of FIG. 1.

FIGS. 1 and 2 illustrate an adapter 30 that may be removably coupled with a tooth horn 32 of a bucket, shovel or other part of an excavating machine or excavation equipment component. Accordingly, adapter 30 includes a first end 34 configured to receive tooth horn 32 at least partially therein. A second end 36 of adapter 30 is configured to receive a removable tooth 33 thereon. A main retainer pin 38 secures removable tooth 33 in place upon adapter 30. A secondary retainer pin 40 engages main retainer pin 38 to prevent lateral movement of main retainer pin 38 along an imaginary longitudinal central axis of main retainer pin 38, to prevent decoupling of removable tooth 33 and adapter 30. Secondary retainer pin 40 may be retracted from engagement with main retainer pin 38 to allow the removal of main retainer pin 38 from adapter 30. After main retainer pin 38 is removed from adapter 30, removable tooth 33 and adapter 30 may be decoupled. Secondary retainer pin 40 may be extended and/or retracted to/from engagement with main retainer pin 38 by hand, and/or using simple hand tools.

Main retainer pin 38 and secondary retainer pin 40 cooperate to provide for the simplified installation and/or removal of removable tooth 33 from adapter 30. Such removable teeth may be installed, removed or replaced by an operator in the field, quickly and easily. The configuration of adapter assembly 30, main retainer pin 38 and secondary retainer pin 40 prevent shifting of main retainer pin 38, during use.

Removable tooth 33 is subject to significant wear and tear during excavation and/or mining operations. Extreme shock loading is experienced as removable tooth 33 impacts adjacent earth, rocks, and other abrasive material. Therefore, it is desirable to make removable tooth 33 readily replaceable with a new or reconditioned tooth of similar or identical configuration. Otherwise, adapter 30, or buckets, shovels or other excavation equipment would need to be replaced more frequently, increasing equipment and labor costs associated therewith. By providing a removable tooth 33 at a location upon adapter 30 that would otherwise experience the most wear, the service life of such equipment is prolonged by replacing selected parts associated with the excavation equipment.

In order to prevent excessive wear of adapter 30 and/or tooth horn 32, for example, removable tooth 33 is coupled with and at least partially conceals and/or protects adapter 30 from abrasive materials during excavation. Removable tooth 33 includes a rigid tapered body portion 42. Tapered body portion 42 generally includes four sides 46–49, which cooperate to define a recess 50 at first end 34. Recess 50 is configured to receive adapter 30 at least partially therein. Sides 46 and 48 are spaced from one another at first adapter end 34. Sides 46 and 48 are tapered, and converge at second end 36.

Sides 46 and 48 include respective openings 52 and 53, which are configured to receive main retainer pin 38 at least partially therethrough. Openings 52 and 53 are generally aligned with one another, such that main retainer pin 38 may extend at least partially through each of openings 52 and 53, while removable tooth 33 is in an installed position. The respective positions of opening 52 and 53 upon sides 46 and 48, respectively, are selected to align with an elongate slot 44 that extends from a first side 54 of adapter 30 to a second side 55 of adapter 30. In other words, when removable tooth 33 is properly positioned upon adapter 30, elongate slot 44, and openings 52 and 53 are aligned such that an imaginary central longitudinal axis I through elongate slot 44 extends through opening 52 and 53. This allows main retainer pin 38 to extend from elongate slot 44 at least partially into each of openings 52 and 53, while main retainer pin 38 is in the installed position.

The configuration of tapered body portion 42 may vary significantly within the teachings of the present invention. For example, although sides 46 and 48 are each tapered and sides 47 and 49 are generally parallel with one another, other embodiments may include only one tapered side. Alternatively, more than two of sides 4649 may be tapered, within the teachings of the present invention. Furthermore, tapered body portion 42 may include more than four sides in various embodiments. In general, the configuration of removable tooth 33 and tapered body portion 42 are selected to receive and provide protection to second end 36 of adapter 30, and to provide a material engaging surface 58 to removable tooth 33.

Adapter 30 includes another elongate slot 45 that extends from a third side 56 of adapter 30, to elongate slot 44. Elongate slot 45 is configured to receive secondary retainer pin 40. Secondary retainer pin 40 includes threads 60 that extends along a mid-portion of secondary retainer pin 40. Threads 60 are configured to cooperate with a corresponding threaded portion 62 associated with adapter 30 and located adjacent elongate slot 45. A screw head 64 is positioned at one end of secondary retainer pin 40. Screw head 64 is configured to cooperate with a corresponding shoulder 66 formed by the configuration of elongate slot 45. Shoulder 66 prevents secondary retainer pin 40 from being inserted within elongate slot 45 beyond an installed position of secondary retainer pin 40.

Screw head 64 also includes at least one groove 68, which is configured to cooperate with a tool to extend or retract secondary retainer pin 40 to/from the installed position within elongate slot 45. Groove 68 may be configured to cooperate with simple hand tools, such as a screwdriver or power drill head. Accordingly, groove 68 may include a standard or phillips head type screw receptacle. In other embodiments, groove 68 may comprise a protrusion configured to cooperate with tools other than those described above. For example, screw head 64 may include a fastener head configuration in order to cooperate with various hand or power (impact) wrenches. The specific configuration of screw head 64 may vary significantly within the teachings of the present invention. The configuration is generally selected to cooperate with one or more hand or power tools to allow for the installation or removal of secondary retainer pin 40 from elongate slot 45.

The tip 70 of secondary retainer pin's 40 other end is configured to be received within a recess 72 associated with main retainer pin 38. In the illustrated embodiment, recess 72 comprises a circumferential groove extending along the surface 73 of main retainer pin 38. However, other configurations are possible for recess 72. For example, recess 72 may include a partial circumferential groove which does not extend around the entire surface 73 of main retainer pin 38. Alternatively, recess 72 may comprise a hole extending at least partially into the surface 73 of main retainer pin 38. Any recessed portion of any size or configuration suitable to receive a tip similar to tip 70, and prevent lateral movement of main retainer pin 38, is suitable for use within the teachings of the present invention.

In the illustrated embodiment, screw head 64 is recessed with respect to an exterior surface 74 of side 56 of adapter 30. Accordingly, adapter 30 protects screw head 64 and secondary retainer pin 40 from abrasive material encountered during operation. Similarly, the location of elongate slot 45 upon side 56 of adapter 30 prevents contact between removable tooth 33 during the installation of removable tooth 33, and during operation. In another embodiment, elongate slot 45 may extend through a face 76 of removable tooth 33. In this embodiment, secondary retainer pin 40 would be installed through an opening (not shown) through face 76 and into elongate slot 45. In the illustrated embodiment of FIG. 2, this configuration would change the orientation of secondary retainer pin 40 and elongate slot 45, with respect to removable tooth 33.

Main retainer pin 38 of the present invention is configured such that its ends are recessed with respect to the surfaces of sides 46 and 48 of removable tooth 33. This feature protects main retainer pin 38 from damage or breakage during operation. In a particular embodiment of the present invention, main retainer pin 38 need only be long enough to protrude slightly into openings 52 and 53, to allow retainer pin to cooperate with removable tooth 33, adjacent openings 52 and 53, to maintain the coupling between removable tooth 33 and adapter 30.

In order to install removable tooth 33 upon adapter 30, recess 50 of removable tooth 33 is aligned with second end 36 of adapter 30, and removable tooth 33 is placed over second end 36. Openings 52 and 53 of sides 46 and 48, respectively, are each aligned with elongate slot 44. Main retainer pin 38 is inserted through opening 52, elongate slot 44, and at least partially into opening 53. In its installed position, main retainer pin 38 extends from elongate slot 44 at least partially into each of openings 52 and 53.

Secondary retainer pin 40 is installed within elongate slot 45 until threads 60 engage threaded portion 62 of adapter 30. Rotation of screw head 64 in a clockwise direction directs secondary retainer pin 40 into elongate slot 45, toward elongate slot 44. Secondary retainer pin 40 is prevented from additional movement toward main retainer pin 38 when screw head 64 engages shoulder 66 and/or tip 70 engages main retainer pin 38. While secondary retainer pin 40 is in the installed position, tip 70 and recess 72 cooperate to prevent lateral motion of main retainer pin 38 along imaginary longitudinal axis I through elongate slot 44.

Secondary retainer pin 40 may be disengaged from main retainer pin 38 by rotating secondary retainer pin 40 in the opposite direction. Therefore, tip 70 may be extended or retracted to or from engagement with main retainer pin 38 by rotating screw head 64 in opposite directions. In the illustrated embodiment, secondary retainer pin 40 may be unscrewed and completely removed from adapter 30. This feature allows repair and or replacement of damaged components (e.g., secondary retainer pins, adapters). However, in other embodiments, secondary retainer pin 40 may be permanently coupled with, or integral to adapter 30.

In order to decouple removable tooth 33 and adapter 30, secondary retainer pin 40 is rotated and retracted away from main retainer pin 38, until tip 70 clears the surface 74 of main retainer pin 38. This allows main retainer pin 38 to be removed from adapter 30. Accordingly, removable tooth 33 may be removed, reconditioned, and/or replaced upon adapter 30.

The teachings of the present invention may be used for coupling various excavation, earth moving, and/or mining equipment components. In general, any removable and/or replaceable component will benefit from the fastening and component cooperation techniques disclosed herein. More specifically, removable adapters may be coupled with tooth horns of buckets, shovels, or practically any heavy equipment components in accordance with the present invention. Similarly, ripper shanks may be coupled with various removable components provided to protect the ripper shank and/or prolong the life of the ripper shank. Another example of excavation equipment incorporating aspects of the present invention is described with regard to FIGS. 3 and 4.

Figure 3:
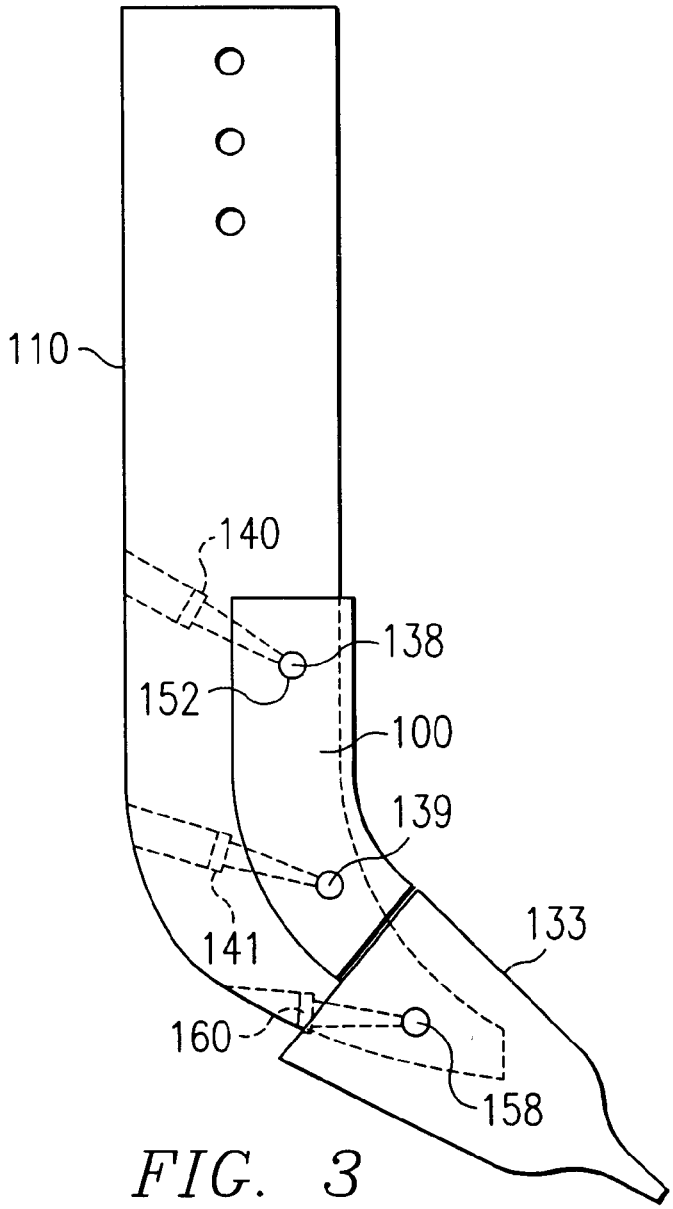
FIG. 3 is a side view of a ripper shank coupled with a removable tooth, and shroud, in accordance with a particular embodiment of the present invention.
Figure 4:
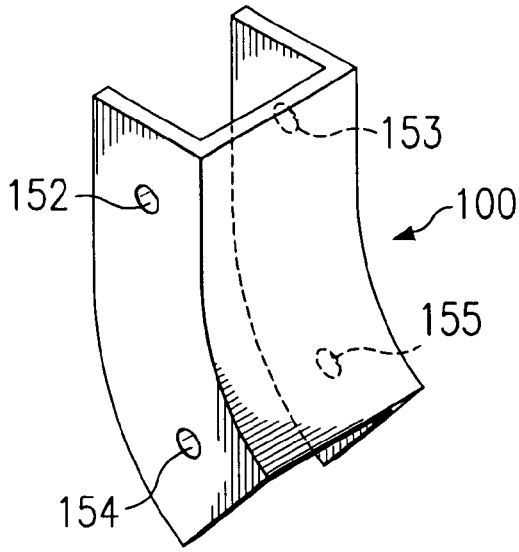
FIG. 4 is an isometric view of the shroud of FIG. 3.

FIGS. 3 and 4 illustrate a shroud 100 coupled with a shank 110 of an excavating machine part. Shank 110 may be referred to as a "ripper shank." For the purposes of this specification, a shank is a type of adapter which may be coupled with various excavation equipment components, and may receive one or more removable teeth. Shroud 100 provides protection to shank 110 when the excavating machine is in use. The excavating machine may be a dragline used in mining operations or any other machine used for excavating purposes. Shroud 100 is coupled with shank 110 using main retainer pin 138, which is similar in configuration to main retainer pin 38 of FIG. 1. Accordingly, fastening components similar to the main retainer pins and secondary retainer pins described herein may be used to couple shroud 100 with shank 110. Similarly, such retaining pins and secondary retainer pins may be used to couple shank 110 with the excavation equipment component.

Main retainer pin 138 may be inserted through opening 152, into an elongate slot through shank 110, and extend at least partially into opening 153. In a similar manner, a secondary retainer pin 139 may be inserted through opening 154, into another elongate slot, and extend at least partially into opening 155. Secondary retainer pins 140 and 141 engage main retainer pins 138 and 139, respectively, to prevent lateral movement of main retainer pins 138 and 139. For purposes of this specification, shroud 100 may be considered a removable tooth, which protects one end of shank 110.

Shroud 100 is used to protect shank 110 from the abrasive environment encountered during excavation. Accordingly, shroud 100 is placed at a location upon shank 110 where significant wear and tear is anticipated. By providing a removable shroud 100 and removable tooth point 220, wear and degradation of shank 210 is reduced, thereby increasing its overall service life.

Removable tooth 133 is coupled with shank 110 using main retainer pin 158 and secondary retainer pin 160. Each of main retainer pins 138, 139 and 158, and secondary retainer pins 140, 141 and 160 are configured and function similarly to main retainer pin 38 and secondary retainer pin 40, respectively, to couple shroud 100 and tooth 133 with shank 110.

Although secondary retainer pin 40 of the present invention includes threads and a screw head, various configurations are available for secondary retainer pin 40. For example, secondary retainer pin 40 may be any retainer pin (e.g., a set screw) configured to be installed within elongate slot 45, and to cooperate with recess 72 to prevent lateral movement of main retainer pin 38.

In the illustrated embodiment, main retainer pin 38 of FIGS. 1 and 2 extends through elongate slot 44, and at least partially into openings 52 and 53 of removable tooth 33. However, in alternative embodiments, the main retainer pin(s) used to couple removable tooth 33 and an adapter may be more than one piece. For example, in lieu of main retainer pin 38, two main retainer pins could be used, within the teachings of the present invention. The main retainer pins would extend from opposite sides of adapter 30 to couple removable tooth 33 with adapter 30. In this embodiment, each main retainer pin would have an independent secondary retainer pin, to prevent lateral movement of the main retainer pins.

If two separate main retainer pins are used, then elongate slot 44 need not extend all the way through adapter 30. Instead, two separate slots would be located on opposing sides of adapter 30, each slot configured to receive one of the main retainer pins. However, two independent main retainer pins could also be used with an elongate slot that extends all the way through adapter 30, similar to elongate slot 44. In order to accommodate two independent secondary retainer pins, adapter 30 would incorporate two secondary elongate slots, in order to accommodate two secondary retainer pins.

Although embodiments of the invention and their advantages are described in detail, a person skilled in the art could make various alterations, additions, and omissions without departing from the spirit and scope of the present invention as defined by the appended claims.

What is claimed is:

1. An adapter assembly for use with excavation equipment, comprising:

an adapter having first and second adapter ends, and first and second adapter sides;

a removable tooth having first and second tooth sides, the removable tooth being coupled with the adapter and at least partially covering the first adapter end;

a central portion of the adapter defining a first elongate slot which extends from the first adapter side to the second adapter side;

the first and second tooth sides having first and second openings, respectively, configured such that the first and second openings are aligned with an imaginary longitudinal axis of the first elongate slot while the removable tooth is coupled with the adapter;

a first retainer pin extending at least partially through the first and second openings and the first elongate slot, the first retainer pin being operable to cooperate with the removable tooth, adjacent the first and second openings, to couple the removable tooth and the adapter; and a second retainer pin extending from the adapter and least partially into the first elongate slot and engaging a recessed portion of the first retainer pin, the second retainer pin being operable to limit movement of the first retainer pin along the imaginary longitudinal axis.

2. The adapter assembly of claim 1, wherein the recessed portion of the first retainer pin comprises a circumferential groove extending along a surface of the first retainer pin.

3. The adapter assembly of claim 1, wherein the second retainer pin extends at least partially through a second elongate slot which extends from a third adapter side to the first elongate slot.

4. The adapter assembly of claim 3, wherein the second elongate slot includes a threaded region operable to engage corresponding threads of the second retainer pin, and a recessed shoulder configured to prevent movement of the second retainer pin toward the first retainer pin, beyond an installed position of the second retainer pin.

5. The adapter assembly of claim 4, wherein the second retainer pin includes a screw head having a first end operable to engage the recessed shoulder while the second retainer pin is in the installed position, and a second end configured to cooperate with an installation tool to allow rotation of the second retainer pin to the installed position.

6. The adapter assembly of claim 1, wherein the adapter comprises a ripper shank.

7. The adapter assembly of claim 1, wherein the removable tooth comprises a removable shroud.

8. The adapter assembly of claim 1, wherein the first retainer pin is slightly recessed with respect to first and second outer surfaces of the first and second adapter sides, respectively.

9. The adapter assembly of claim 1, wherein the second adapter end is configured to be coupled with an excavation equipment component.

10. A method for coupling a removable tooth and an adapter assembly, comprising:

providing a first adapter having first and second adapter ends, and first and second adapter sides;

installing a removable tooth at least partially over the first adapter end, the removable tooth having first and second tooth sides;

inserting a first retainer pin through a first opening of the first tooth side, into a first elongate slot which extends from the first adapter side to the second adapter side, and at least partially through a second opening of the second tooth side;

the first retainer pin being operable to cooperate with the removable tooth adjacent the first and second openings to couple the removable tooth and the adapter; and rotating a second retainer pin which extends from the adapter at least partially into the first elongate slot, until the second retainer pin engages a recess in the first retainer pin, the second retainer pin being operable to limit lateral movement of the first retainer pin along an imaginary longitudinal axis of the first retainer pin.

11. The method of claim 10, further comprising inserting the second retainer pin through a third opening through a face of the adapter and into the elongate slot.

12. An adapter assembly for use with excavation equipment, comprising:

an adapter having first and second adapter ends, and first and second adapter sides;

a removable tooth having first and second tooth sides, the removable tooth being coupled with the adapter and at least partially covering the first adapter end;

a central portion of the adapter defining first and second slots which extend at least partially into the first adapter side and the second adapter side, respectively;

the first and second tooth sides having first and second openings, respectively, configured such that the first and second openings are aligned with the first and second slots, respectively, while the removable tooth is coupled with the adapter;

first and second retainer pins extending from the first and second slots, respectively, and at least partially through the first and second openings, respectively, the first and second retainer pins being operable to cooperate with the removable tooth adjacent the first and second openings, respectively, to couple the removable tooth and the adapter; and third and fourth retainer pins extending from the adapter and least partially into the first and second slots, respectively, and engaging first and second recessed portions, respectively, of the first and second retainer pins, respectively, the third and fourth retainer pins being operable to limit lateral movement of the first and second retainer pins, respectively.

* * * * *